US009321553B1

(12) United States Patent
Spivey, Sr. et al.

(10) Patent No.: US 9,321,553 B1
(45) Date of Patent: Apr. 26, 2016

(54) CARTON WITH HANDLE

(71) Applicant: Graphic Packaging International, Inc., Atlanta, GA (US)

(72) Inventors: Raymond R. Spivey, Sr., Mableton, GA (US); Jean-Manuel Gomes, Acworth, GA (US); Colin P. Ford, Woodstock, GA (US); Li Wei Yang, Shanghai (CN)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/976,164

(22) Filed: Dec. 21, 2015

Related U.S. Application Data

(63) Continuation of application No. 14/176,546, filed on Feb. 10, 2014.

(60) Provisional application No. 61/850,238, filed on Feb. 11, 2013.

(51) Int. Cl.
*B65D 5/462* (2006.01)
*B65D 5/46* (2006.01)
(Continued)

(52) U.S. Cl.
CPC ..... *B65D 5/46088* (2013.01); *B65D 5/4204* (2013.01); *B65D 5/542* (2013.01)

(58) Field of Classification Search
CPC ..... B65D 5/46088; B65D 5/46096; B65D 5/46104; B65D 5/46112; B65D 5/4612; B65D 5/46128; B65D 5/46136; B65D 5/46144; B65D 5/46152; B65D 5/4616; B65D 5/46168; B65D 5/46176
USPC ..... 229/117.13, 117.14, 117.15, 117.22; 206/141, 427
See application file for complete search history.

(56) References Cited

U.S. PATENT DOCUMENTS 1,253,193 A * 1/1918 Hill ..... B65D 5/46192 229/117.12
1,624,439 A * 4/1927 Senat ..... B65D 5/46088 229/117.14

(Continued)

FOREIGN PATENT DOCUMENTS

CA 877792 * 8/1971
CA 2160145 * 9/1995

(Continued)

OTHER PUBLICATIONS

International Search Report and Written Opinion for PCT/US2013/027913 dated Jul. 1, 2013.*

*Primary Examiner* — Gary Elkins
(74) *Attorney, Agent, or Firm* — Womble Carlyle Sandridge & Rice, LLP

(57) ABSTRACT

A carton for holding a plurality of articles. The carton comprises a plurality of panels that extends at least partially around an interior of the carton and comprises at least a top panel. A handle is positionable between a first position and a second position. The handle comprises at least a first handle panel and a second handle panel, and at least one of the first handle panel and the second handle panel is foldably connected to the top panel. At least one of the first handle panel and the second handle panel is generally coplanar with at least a portion of the top panel in the first position of the handle. Each of the first handle panel and the second handle panel extends upwardly relative to the top panel and the first handle panel is spaced apart from the second handle panel in the second position of the handle.

24 Claims, 9 Drawing Sheets

(51) Int. Cl.
*B65D 5/54* (2006.01)
*B65D 5/42* (2006.01)

(56) References Cited

U.S. PATENT DOCUMENTS 2,111,621 A * 3/1938 Gerking ..... B65D 71/0014 206/198
2,252,023 A * 8/1941 Mulnix ..... B65D 5/46152 229/117.15
2,268,906 A * 1/1942 Scheer ..... B65D 5/4616 229/117.15
2,383,183 A * 8/1945 Fischer ..... B65D 71/0011 206/427
2,575,654 A * 11/1951 Casler ..... B65D 71/0022 206/183
2,594,376 A * 4/1952 Arneson ..... B65D 71/0037 206/172
2,661,142 A * 12/1953 Hendrickson, Jr. B65D 5/46072 229/117.13
2,663,485 A * 12/1953 Johnson ..... B65D 5/4612 229/117.15
2,694,518 A * 11/1954 Zanck ..... B65D 5/4616 229/117.14
2,702,144 A * 2/1955 Forrer ..... B65D 71/0022 206/171
2,737,326 A * 3/1956 Toensmeier ..... B65D 71/46 206/153
2,764,284 A * 9/1956 Arneson ..... B65D 71/46 206/147
2,797,856 A * 7/1957 Jaeschke ..... B65D 5/46192 229/117.13
2,810,506 A * 10/1957 Kessler ..... B65D 5/2052 229/101
2,868,433 A * 1/1959 Anderson, Jr. ..... B65D 5/46192 229/117.13
2,911,136 A * 11/1959 Stone ..... B65D 71/16 206/140
2,950,041 A * 8/1960 Stone ..... B65D 71/16 206/147
2,955,739 A * 10/1960 Collura ..... B65D 5/46192 206/428
2,975,934 A * 3/1961 Powell ..... B65D 71/26 206/192
2,990,997 A * 7/1961 Weiss ..... B65D 71/20 206/140
3,112,856 A * 12/1963 MacIntosh ..... B65D 5/46192 206/434
3,127,720 A * 4/1964 Garrard ..... B65B 11/105 53/48.7
3,167,214 A * 1/1965 Mahon ..... B65D 71/16 206/155
3,198,378 A * 8/1965 Farquhar ..... B65D 71/0066 206/194
3,204,815 A * 9/1965 Weiss ..... B65D 71/0077 206/171
3,245,711 A * 4/1966 Dantoin ..... B65D 71/44 206/153
3,309,005 A * 3/1967 Pilger ..... B65D 5/0005 229/101
3,313,406 A * 4/1967 Outwater ..... B65D 71/16 206/431
3,334,767 A * 8/1967 Cornelius ..... B65D 1/243 220/23.6
3,355,012 A * 11/1967 Weiss ..... B65D 5/48036 206/194
3,381,881 A * 5/1968 Ganz ..... B65D 71/18 206/140
3,534,899 A * 10/1970 Hoshi ..... B65D 5/46088 229/117.15
3,612,266 A * 10/1971 Graser ..... B65D 71/48 206/140
3,722,945 A * 3/1973 Wood ..... B65D 71/46 206/153
3,747,835 A * 7/1973 Graser ..... B65D 71/16 206/152
3,767,041 A * 10/1973 Graser ..... B65D 71/48 206/148
3,790,066 A * 2/1974 Malinowski ..... B65D 5/548 229/117.13
3,828,926 A * 8/1974 Rossi ..... B65D 71/16 206/427
3,860,281 A * 1/1975 Wood ..... B65D 71/48 206/158
3,886,901 A * 6/1975 Zeitter ..... A01K 1/0125 119/168
3,904,036 A * 9/1975 Forrer ..... B65D 71/36 206/427
3,933,303 A * 1/1976 Kirby, Jr. ..... B65D 5/4608 206/141
3,942,631 A * 3/1976 Sutherland ..... B65D 71/0048 206/154
3,994,432 A * 11/1976 Kirby, Jr. ..... B65D 71/30 206/141
4,029,204 A * 6/1977 Manizza ..... B65D 71/16 206/140
4,032,053 A * 6/1977 Wilson ..... A45C 11/00 206/428
4,034,852 A * 7/1977 Forrer ..... B65D 71/30 206/141
4,036,423 A * 7/1977 Gordon ..... B65D 81/3453 229/101
4,096,985 A * 6/1978 Wood ..... B65D 71/125 206/427
4,111,306 A * 9/1978 Roccaforte ..... A21B 3/131 229/101
4,140,267 A * 2/1979 Scott ..... B65D 5/46088 229/117.15
4,164,286 A * 8/1979 Sutherland ..... B65D 71/26 206/434
4,171,763 A * 10/1979 Card ..... B65D 5/46088 229/117.15
4,180,191 A * 12/1979 Wood ..... B65D 71/48 206/147
4,188,766 A * 2/1980 Culpepper ..... B65D 71/46 53/48.5
4,192,540 A * 3/1980 Oliff ..... B65D 71/46 206/161
4,195,765 A * 4/1980 Roccaforte ..... B65D 5/46088 229/117.15
4,202,446 A * 5/1980 Sutherland ..... B65D 71/36 206/1.5
4,216,861 A * 8/1980 Oliff ..... B65D 5/061 206/427
4,244,617 A * 1/1981 Manizza ..... B65D 71/48 206/153
4,308,995 A * 1/1982 Hanes ..... B65D 5/46096 206/141
4,311,268 A * 1/1982 Soliven ..... B65D 5/46096 229/117.12
4,318,474 A * 3/1982 Hasegawa ..... B65D 5/542 206/199
4,318,476 A * 3/1982 Wood ..... B65D 71/46 206/153
4,326,628 A * 4/1982 Wood ..... B65D 71/48 206/153
4,329,923 A * 5/1982 Iida ..... B41F 31/045 101/365
4,331,289 A * 5/1982 Killy ..... B65D 5/5435 206/132
4,336,898 A * 6/1982 Joyce ..... B65D 71/46 206/148
4,364,509 A * 12/1982 Holley, Jr. ..... B65D 5/722 206/141
4,375,258 A * 3/1983 Crayne ..... B65D 5/5405 206/141
4,378,905 A * 4/1983 Roccaforte ..... B65D 5/46152 229/117.12
4,382,505 A * 5/1983 Sutherland ..... B65D 71/36 206/180
4,386,699 A * 6/1983 Sutherland ..... B65D 71/14 206/434
4,415,082 A * 11/1983 Martin ..... B65D 5/46016 206/431

(56) References Cited

U.S. PATENT DOCUMENTS 4,424,901 A * 1/1984 Lanier ..... B65D 71/34 206/141
4,432,579 A * 2/1984 Denmark ..... B65D 71/46 206/158
4,438,843 A * 3/1984 Graser ..... B65D 71/36 206/148
4,440,340 A * 4/1984 Bakx ..... B65D 71/36 206/140
4,478,334 A * 10/1984 Graser ..... B65D 5/548 206/141
4,482,090 A * 11/1984 Milliens ..... B65D 71/36 206/155
4,498,619 A * 2/1985 Roccaforte ..... B65D 5/46192 229/117.09
4,508,258 A * 4/1985 Graser ..... B65D 71/36 206/427
4,538,759 A * 9/1985 Dutcher ..... B65D 5/46088 206/427
4,545,485 A * 10/1985 Oliff ..... B65D 71/18 206/147
4,546,914 A * 10/1985 Roccaforte ..... B65D 5/46088 206/141
4,566,591 A * 1/1986 Turtschan ..... B65D 71/42 206/148
4,566,593 A * 1/1986 Muller ..... B65D 71/16 206/434
4,582,199 A * 4/1986 Schuster ..... B65D 5/46192 206/427
4,588,084 A * 5/1986 Holley, Jr. ..... B65D 71/36 206/427
4,653,686 A * 3/1987 Wood ..... B65D 71/36 206/141
4,681,217 A * 7/1987 Hernandez ..... B65D 71/30 206/141
4,700,831 A * 10/1987 Kassai ..... B65D 5/4204 206/232
4,706,876 A * 11/1987 Wilson ..... B65D 5/4608 206/427
4,747,487 A * 5/1988 Wood ..... B65D 71/36 206/427
4,784,266 A * 11/1988 Chaussadas ..... B65D 71/16 206/139
4,784,316 A * 11/1988 Crouch ..... B65D 5/4608 206/141
4,785,991 A * 11/1988 Schuster ..... B65D 5/4608 206/141
4,802,583 A * 2/1989 Calvert ..... B65D 5/22 206/139
4,830,267 A * 5/1989 Wilson ..... B65D 71/36 206/141
4,875,586 A * 10/1989 Chaussadas ..... B65D 71/16 206/158
4,925,019 A * 5/1990 Ganz ..... B65D 71/36 206/145
4,941,624 A * 7/1990 Schuster ..... B65D 71/36 206/140
4,966,324 A * 10/1990 Steel ..... B65D 5/4608 206/140
5,002,186 A * 3/1991 Cooper ..... B65D 71/36 206/193
5,020,337 A * 6/1991 Krieg ..... F25D 3/06 229/103
5,060,792 A * 10/1991 Oliff ..... B65D 71/14 206/140
5,060,804 A * 10/1991 Beales ..... B65D 71/36 206/831
5,094,359 A * 3/1992 DeMars ..... B65D 5/603 206/427
5,106,014 A * 4/1992 Miller ..... B65D 5/4608 229/117.12
5,119,985 A * 6/1992 Dawson ..... B65D 5/4608 229/117.12
5,135,104 A * 8/1992 Jorba ..... B65D 71/48 206/151
5,139,147 A * 8/1992 Sutherland ..... B65D 71/42 206/147
5,167,325 A * 12/1992 Sykora ..... B65D 71/0055 206/140
5,188,225 A * 2/1993 Jorba ..... B65D 71/48 206/145
5,197,598 A * 3/1993 Stout ..... B65D 71/36 206/141
5,221,041 A * 6/1993 Stout ..... B65D 71/32 206/141
5,221,042 A * 6/1993 Oliff ..... B65D 5/4608 206/427
5,222,658 A * 6/1993 DeMaio ..... B65D 5/4608 206/427
5,234,102 A * 8/1993 Schuster ..... B65D 71/36 206/141
5,246,112 A * 9/1993 Stout ..... B65D 71/36 206/140
5,273,156 A * 12/1993 Harris ..... B65D 71/48 206/147
5,284,294 A * 2/1994 Floyd ..... B65D 5/248 229/117.15
5,292,058 A * 3/1994 Zoss ..... B65D 5/029 206/268
5,292,059 A * 3/1994 Oliff ..... B65D 5/0263 229/117.13
5,297,673 A * 3/1994 Sutherland ..... B65D 71/16 206/147
5,297,725 A * 3/1994 Sutherland ..... B65D 71/36 229/117.13
5,303,863 A * 4/1994 Arasim ..... B65D 71/36 206/542
5,307,932 A * 5/1994 Stout ..... B65D 71/36 206/141
5,307,986 A * 5/1994 Schuster ..... B65D 5/0005 229/101
5,310,050 A * 5/1994 Sutherland ..... B65D 71/20 206/147
5,310,051 A * 5/1994 Sutherland ..... B65D 71/44 206/153
5,320,277 A * 6/1994 Stout ..... B65D 5/443 229/117.13
5,323,895 A * 6/1994 Sutherland ..... B65D 71/40 206/147
5,328,024 A * 7/1994 Sutherland ..... B65D 71/406 206/153
5,333,734 A * 8/1994 Stout ..... B65D 71/36 206/427
5,344,006 A * 9/1994 Mazzeo ..... B65D 71/48 206/147
5,351,815 A * 10/1994 Fogle ..... B65D 71/48 206/147
5,351,816 A * 10/1994 Sutherland ..... B65D 71/48 206/147
5,351,817 A * 10/1994 Sutherland ..... B65D 71/42 206/147
5,355,999 A * 10/1994 Sutherland ..... B65D 71/42 206/147
5,360,104 A * 11/1994 Sutherland ..... B65D 71/36 206/147
5,363,954 A * 11/1994 Dampier ..... B65B 17/025 206/144
5,379,944 A * 1/1995 Stout ..... B65D 71/36 229/117.13
5,381,891 A * 1/1995 Harris ..... B65D 71/16 206/141
5,385,234 A * 1/1995 Stout ..... B65D 5/54 206/427
5,390,784 A * 2/1995 Sutherland ..... B65D 71/36 206/140
5,395,044 A * 3/1995 Stout ..... B65D 71/36 229/117.13
5,407,065 A * 4/1995 Sutherland ..... B65D 71/44 206/147
5,415,278 A * 5/1995 Sutherland ..... B65D 71/46 206/148
5,427,241 A * 6/1995 Sutherland ..... B65D 71/36 206/141

(56) References Cited

U.S. PATENT DOCUMENTS 5,443,153 A * 8/1995 Sutherland ..... B65D 71/44 206/152
5,445,262 A * 8/1995 Sutherland ..... B65D 71/46 206/148
5,452,799 A * 9/1995 Sutherland ..... B65D 71/44 206/153
5,458,234 A * 10/1995 Harris ..... B65D 71/0022 206/175
5,472,090 A * 12/1995 Sutherland ..... B65D 71/16 206/140
5,474,172 A * 12/1995 Zavatone ..... B65D 71/44 206/147
5,484,059 A * 1/1996 Sutherland ..... B65D 71/18 206/140
5,485,915 A * 1/1996 Harris ..... B65D 71/0055 206/147
5,495,727 A * 3/1996 Strong ..... B65D 81/18 229/101
5,501,335 A * 3/1996 Harris ..... B65D 71/0011 206/162
5,503,267 A * 4/1996 Sutherland ..... B65D 71/48 206/148
5,505,304 A * 4/1996 Broskow ..... B65D 71/0055 206/150
5,520,283 A * 5/1996 Sutherland ..... B65D 71/20 206/140
5,524,756 A * 6/1996 Sutherland ..... B65D 71/16 206/140
5,551,556 A * 9/1996 Sutherland ..... B65D 71/32 206/147
5,582,289 A * 12/1996 Wright ..... B65D 71/16 206/139
5,582,343 A * 12/1996 Dalvey ..... B65D 5/0005 229/101
5,593,027 A * 1/1997 Sutherland ..... B65D 71/36 206/170
5,598,920 A * 2/1997 Hansen ..... B65D 71/46 206/148
5,605,228 A * 2/1997 Baxter ..... B65D 71/16 206/140
5,609,251 A * 3/1997 Harris ..... B65D 71/16 206/141
5,638,956 A * 6/1997 Sutherland ..... B65D 71/20 206/147
5,639,017 A * 6/1997 Fogle ..... B65D 5/46192 229/117.13
5,647,483 A * 7/1997 Harris ..... B65D 71/36 206/427
5,669,500 A * 9/1997 Sutherland ..... B65D 5/0227 206/427
5,687,838 A * 11/1997 Bakx ..... B65D 71/46 206/147
5,699,957 A * 12/1997 Blin ..... B65D 71/36 206/192
5,704,470 A * 1/1998 Sutherland ..... B65D 71/36 206/147
5,735,394 A * 4/1998 Harrelson ..... B65D 71/44 206/151
5,738,217 A * 4/1998 Hunter ..... B65D 21/02 206/194
5,738,273 A * 4/1998 Auclair ..... B65D 5/46192 229/103.2
5,746,310 A * 5/1998 Slomski ..... B65D 71/504 206/150
5,794,778 A * 8/1998 Harris ..... B65D 71/36 206/428
5,816,391 A * 10/1998 Harris ..... B65D 71/44 206/147
5,820,185 A * 10/1998 Gomes ..... B65D 71/48 206/147
5,826,782 A * 10/1998 Stout ..... B65D 71/36 206/427
5,845,776 A * 12/1998 Galbierz ..... B65D 71/48 206/153
5,871,090 A * 2/1999 Doucette ..... B65D 71/0014 206/170
5,873,515 A * 2/1999 Dunn ..... B65D 5/46072 229/117.13
5,878,876 A * 3/1999 Galbierz ..... B65D 71/48 206/148
5,878,946 A * 3/1999 Frerot ..... B65D 5/46192 229/117.13
5,915,546 A * 6/1999 Harrelson ..... B65D 5/46192 206/200
5,960,945 A * 10/1999 Sutherland ..... B65D 71/42 206/147
5,979,747 A * 11/1999 Gnadt ..... B65D 71/0014 229/117.14
5,984,086 A * 11/1999 Foushee ..... B65D 71/16 206/147
5,992,733 A * 11/1999 Gomes ..... B65D 5/46016 229/117.23
D420,575 S * 2/2000 Rovere ..... D9/752
6,019,276 A * 2/2000 Auclair ..... B65D 5/18 229/103.2
6,021,897 A * 2/2000 Sutherland ..... B65D 71/16 206/196
6,065,590 A * 5/2000 Spivey ..... B65D 71/36 206/141
6,070,790 A * 6/2000 Anderson ..... B65D 5/0227 206/807
6,085,969 A * 7/2000 Burgoyne ..... B65D 71/36 206/427
6,105,853 A * 8/2000 Lamare ..... B65D 71/36 229/117.09
6,105,854 A * 8/2000 Spivey ..... B65D 71/36 229/122
6,112,977 A * 9/2000 Sutherland ..... B65D 71/36 206/427
6,131,803 A * 10/2000 Oliff ..... B65D 71/36 229/117.12
6,164,526 A * 12/2000 Dalvey ..... B65D 5/0005 206/427
6,170,741 B1 * 1/2001 Skolik ..... B65D 71/36 206/427
6,223,891 B1 * 5/2001 Devens ..... A24F 15/18 206/102
6,223,892 B1 * 5/2001 Bakx ..... B65D 71/46 206/148
6,227,367 B1 * 5/2001 Harrelson ..... B65D 71/36 206/141
6,260,755 B1 * 7/2001 Bates ..... B65D 71/36 229/117.12
6,302,320 B1 * 10/2001 Stout ..... B65D 5/46192 229/117.13
6,315,111 B1 * 11/2001 Sutherland ..... B65D 71/0055 206/188
D452,154 S * 12/2001 Rhodes ..... D7/605
6,425,520 B1 * 7/2002 Peterson ..... B65D 71/36 229/117.12
6,484,903 B2 * 11/2002 Spivey ..... B65D 71/36 221/303
6,488,322 B2 * 12/2002 Bakx ..... B65D 71/46 206/153
6,502,743 B2 * 1/2003 Ikeda ..... B65D 71/22 206/427
6,523,739 B2 * 2/2003 Heeley ..... B65D 5/46192 229/109
6,615,984 B2 * 9/2003 Saulas ..... B65D 71/46 206/427
6,631,803 B2 * 10/2003 Rhodes ..... B65D 5/542 206/427
6,758,337 B2 * 7/2004 Chargueraud ..... B65D 71/36 206/141
6,779,655 B2 * 8/2004 Olsen ..... B65D 71/504 206/150
6,834,793 B2 * 12/2004 Sutherland ..... B65D 5/5415 229/117.13
6,848,573 B2 * 2/2005 Gould ..... B65D 71/30 206/141
6,869,009 B2 * 3/2005 Sutherland ..... B65D 71/36 229/121

(56) References Cited

U.S. PATENT DOCUMENTS 6,896,130 B2 * 5/2005 Theelen ..... B65D 71/36 206/141
6,899,221 B2 * 5/2005 Skolik ..... B65D 71/36 206/141
6,905,066 B2 * 6/2005 Holley, Jr. ..... B65D 71/36 229/117.13
6,926,193 B2 * 8/2005 Smalley ..... B65D 5/46192 229/117.13
6,945,450 B2 * 9/2005 Rusnock ..... B65D 71/36 229/101
6,981,631 B2 * 1/2006 Fogle ..... B65D 71/34 206/431
7,011,209 B2 * 3/2006 Sutherland ..... B65D 71/30 206/175
7,234,596 B2 * 6/2007 Lebras ..... B65D 5/324 206/427
7,264,114 B2 * 9/2007 Daniel ..... B65D 71/46 206/152
7,296,731 B2 * 11/2007 Auclair ..... B65D 5/725 206/427
7,380,701 B2 * 6/2008 Fogle ..... B65D 71/34 206/431
7,416,109 B2 * 8/2008 Sutherland ..... B65D 5/5415 229/117.13
7,427,010 B2 * 9/2008 Sutherland ..... B65D 71/20 206/140
7,472,791 B2 * 1/2009 Spivey, Sr. ..... B65D 71/36 206/427
7,601,111 B2 * 10/2009 Sutherland ..... B65D 5/241 493/51
7,699,215 B2 * 4/2010 Spivey, Sr. ..... B65D 71/36 206/427
7,743,944 B2 * 6/2010 Ho Fung ..... B65D 5/5253 221/305
7,743,969 B2 * 6/2010 Bokel ..... B65D 71/36 206/427
7,748,603 B2 * 7/2010 Fogle ..... B65D 71/36 206/427
7,757,933 B2 * 7/2010 Dunn ..... B65D 71/36 206/427
7,806,314 B2 * 10/2010 Sutherland ..... B65D 71/36 206/427
8,070,052 B2 * 12/2011 Spivey, Sr. ..... B65D 71/36 229/117.13
8,216,118 B2 * 7/2012 Dunn ..... B65D 71/36 229/117.13
8,256,617 B2 * 9/2012 Gomes ..... B65D 71/48 206/147
8,453,918 B2 * 6/2013 Hsiao ..... B65D 5/4208 206/806
8,469,184 B2 * 6/2013 Spivey, Sr. ..... B65D 71/406 206/141
8,511,463 B2 * 8/2013 Brand ..... B65D 71/0022 206/167
2002/0195371 A1 * 12/2002 Brown ..... A47G 23/0641 206/564
2003/0080004 A1 * 5/2003 Olsen ..... B65D 71/504 206/150
2003/0111362 A1 * 6/2003 Sutherland ..... B65D 71/30 206/162
2003/0213263 A1 * 11/2003 Woog ..... A45C 11/20 62/457.7
2003/0213705 A1 * 11/2003 Woog ..... A45C 11/20 206/162
2004/0074954 A1 * 4/2004 Fogle ..... B65D 5/4608 229/117.13
2004/0079666 A1 * 4/2004 Bakx ..... B65D 71/46 206/427
2004/0226833 A1 * 11/2004 Daniel ..... B65D 71/46 206/139
2005/0056658 A1 * 3/2005 Rudolph Spivey ..... A47F 5/112 221/302
2005/0167478 A1 * 8/2005 Holley ..... B65D 71/36 229/117.13
2006/0071058 A1 * 4/2006 Spivey ..... B65D 71/36 229/122
2006/0169755 A1 * 8/2006 Spivey ..... B65D 71/36 229/117.16
2006/0266812 A1 * 11/2006 Von Bokel ..... B65D 71/36 229/117.14
2006/0273143 A1 * 12/2006 Finch ..... B65D 5/0005 229/117.01
2007/0029371 A1 * 2/2007 Theelen ..... B65D 71/36 229/117.13
2007/0039846 A1 * 2/2007 Spivey ..... B65D 71/36 206/427
2007/0051781 A1 * 3/2007 Holley ..... B65D 5/005 229/101
2007/0108261 A1 * 5/2007 Schuster ..... B65D 71/36 229/117.16
2007/0164091 A1 * 7/2007 Fogle ..... B65D 71/36 229/101
2007/0181658 A1 * 8/2007 Sutherland ..... B65D 71/36 229/243
2007/0205255 A1 * 9/2007 Dunn ..... B65D 71/36 229/117.13
2007/0284424 A1 * 12/2007 Holley ..... B65D 71/36 229/101
2007/0295789 A1 * 12/2007 Ho Fung ..... B65D 71/36 229/122
2008/0083820 A1 * 4/2008 Walling ..... B65D 5/54 229/101
2008/0119344 A1 * 5/2008 Sutherland ..... B65D 5/241 493/162
2009/0236408 A1 * 9/2009 Spivey, Sr. ..... B65D 71/36 229/117.13
2009/0255983 A1 * 10/2009 De Paula ..... B65D 5/5435 229/237
2010/0089987 A1 * 4/2010 Brandinelli ..... B65D 5/46032 229/117.22
2010/0213249 A1 * 8/2010 Requena ..... B65D 71/36 229/117.12
2010/0270367 A1 * 10/2010 Brandenburger ..... B65D 5/067 229/117.13
2010/0320098 A1 * 12/2010 Brand ..... B65D 71/0077 206/162
2011/0048975 A1 * 3/2011 Brand ..... B65D 71/0022 206/141
2012/0104079 A1 * 5/2012 Wagner ..... B65D 5/02274 229/117.09

FOREIGN PATENT DOCUMENTS

DE 8514718.4 * 6/1985
DE 9308141.3 U1 * 9/1993 ..... B65D 5/46088
DE 29607374 * 4/1996
DE 19642571 * 5/1997
DE 20112228 * 11/2002
DE 20317334 * 2/2004
DE 202004004248 * 8/2004
DE 202004017954 * 2/2005
DE 202004018649 * 4/2005
EP 48506 * 3/1982
EP 285043 * 10/1988
EP 398835 * 11/1990
EP 412226 * 2/1991
EP 473266 * 3/1992
EP 495197 * 7/1992
EP 541334 * 5/1993
EP 780320 * 6/1997
EP 1070671 * 1/2001
EP 1384679 * 1/2004
EP 1612157 * 1/2006
FR 1274610 A * 9/1961 ..... B65D 5/46152
FR 1494239 * 9/1967
FR 1582235 * 9/1969
FR 2525992 * 11/1983
FR 2579175 * 9/1986
FR 2634456 A1 * 1/1990 ..... 229/117.14
FR 2664239 * 1/1992
FR 2731413 * 9/1996
GB 1342180 * 12/1973
GB 2085391 * 4/1982

(56) References Cited

FOREIGN PATENT DOCUMENTS

| | | | |
|---|---|---|---|
| GB | 2158037 | * | 11/1985 |
| JP | 05-147643 A | * | 6/1993 |
| JP | 8-507486 | * | 8/1996 |
| JP | 2003-146359 | * | 5/2003 |
| JP | 2003-300554 | * | 10/2003 |
| JP | 38-17186 | * | 8/2006 |
| KR | 20-0356729 | * | 7/2004 |
| WO | WO 95/02546 | * | 1/1995 |
| WO | WO 96/27538 | * | 9/1996 |
| WO | WO 97/33807 | * | 9/1997 |
| WO | WO 98/49071 | * | 11/1998 |
| WO | WO 99/01356 | * | 1/1999 |
| WO | WO 99/28207 | * | 6/1999 |
| WO | WO 00/78618 | * | 12/2000 |
| WO | WO 01/66434 | * | 9/2001 |
| WO | WO 02/059011 | * | 8/2002 |
| WO | WO 02/062676 | * | 8/2002 |
| WO | WO 02/079048 | * | 10/2002 |
| WO | WO 03/016167 | * | 2/2003 |
| WO | WO 03/037742 | * | 5/2003 |
| WO | WO 2005/080218 | * | 9/2005 |
| WO | WO 2005/095222 | * | 10/2005 |
| WO | WO 2005/123532 | * | 12/2005 |
| WO | WO 2006/044583 | * | 4/2006 |
| WO | WO 2006/108098 | * | 10/2006 |
| WO | WO 2007/044525 | * | 4/2007 |
| WO | WO 2007/089282 | * | 8/2007 |
| WO | WO 2009/117562 | * | 9/2009 |

* cited by examiner

CARTON WITH HANDLE

CROSS-REFERENCE TO RELATED APPLICATION

This application is a continuation application of U.S. patent application Ser. No. 14/176,546, filed Feb. 10, 2014, which claims the benefit of U.S. Provisional Patent Application No. 61/850,238, filed Feb. 11, 2013.

INCORPORATION BY REFERENCE

The disclosures of U.S. patent application Ser. No. 14/176,546, which was filed Feb. 10, 2014, and U.S. Provisional Patent Application No. 61/850,238, which was filed Feb. 11, 2013, are hereby incorporated by reference as if presented herein in their entirety.

BACKGROUND OF THE DISCLOSURE

The present disclosure generally relates to cartons or carriers for holding beverage containers or other types of articles. More specifically, the present disclosure relates to cartons that include handle features.

SUMMARY OF THE DISCLOSURE

In general, one aspect of the disclosure is directed to a carton for carrying a plurality of articles. The carton comprises at least one top panel, a first side panel, a second side panel, and a bottom panel. The at least one top panel has a handle for grasping and carrying the carton. The handle has reinforcement features and contact features.

In general, one aspect of the disclosure is directed to a carton for holding a plurality of articles. The carton comprises a plurality of panels that extends at least partially around an interior of the carton. The plurality of panels comprises at least a top panel. A handle is positionable between a first position and a second position. The handle comprises at least a first handle panel and a second handle panel, and at least one of the first handle panel and the second handle panel is foldably connected to the top panel. At least one of the first handle panel and the second handle panel is generally coplanar with at least a portion of the top panel in the first position of the handle, and each of the first handle panel and the second handle panel extends upwardly relative to the top panel and the first handle panel is spaced apart from the second handle panel in the second position of the handle.

In another aspect, the present disclosure is generally directed to a blank for forming a carton. The blank comprises a plurality of panels comprising at least a top panel. The blank further comprises handle features for forming a handle that is positionable between a first position and a second position in the carton formed from the blank. The handle features comprise at least a first handle panel and a second handle panel, and at least one of the first handle panel and the second handle panel is foldably connected to the top panel. At least one of the first handle panel and the second handle panel is for being generally coplanar with at least a portion of the top panel in the first position of the handle in the carton formed from the blank. Each of the first handle panel and the second handle panel is for extending upwardly relative to the top panel and the first handle panel is for being spaced apart from the second handle panel in the second position of the handle in the carton formed from the blank.

In another aspect, the present disclosure is generally directed to a method of forming a carton. The method comprises obtaining a blank comprising a plurality of panels comprising at least a top panel, and handle features comprising at least a first handle panel and a second handle panel. At least one of the first handle panel and the second handle panel is foldably connected to the top panel. The method further comprises forming an interior of the carton at least partially defined by the plurality of panels and forming a handle from the handle features. The handle is positionable between a first position and a second position. At least one of the first handle panel and the second handle panel is generally coplanar with at least a portion of the top panel in the first position of the handle. Each of the first handle panel and the second handle panel extends upwardly relative to the top panel and the first handle panel is spaced apart from the second handle panel in the second position of the handle.

Other aspects, features, and details of the present disclosure can be more completely understood by reference to the following detailed description of exemplary embodiments taken in conjunction with the drawings and from the appended claims.

BRIEF DESCRIPTION OF THE D WINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
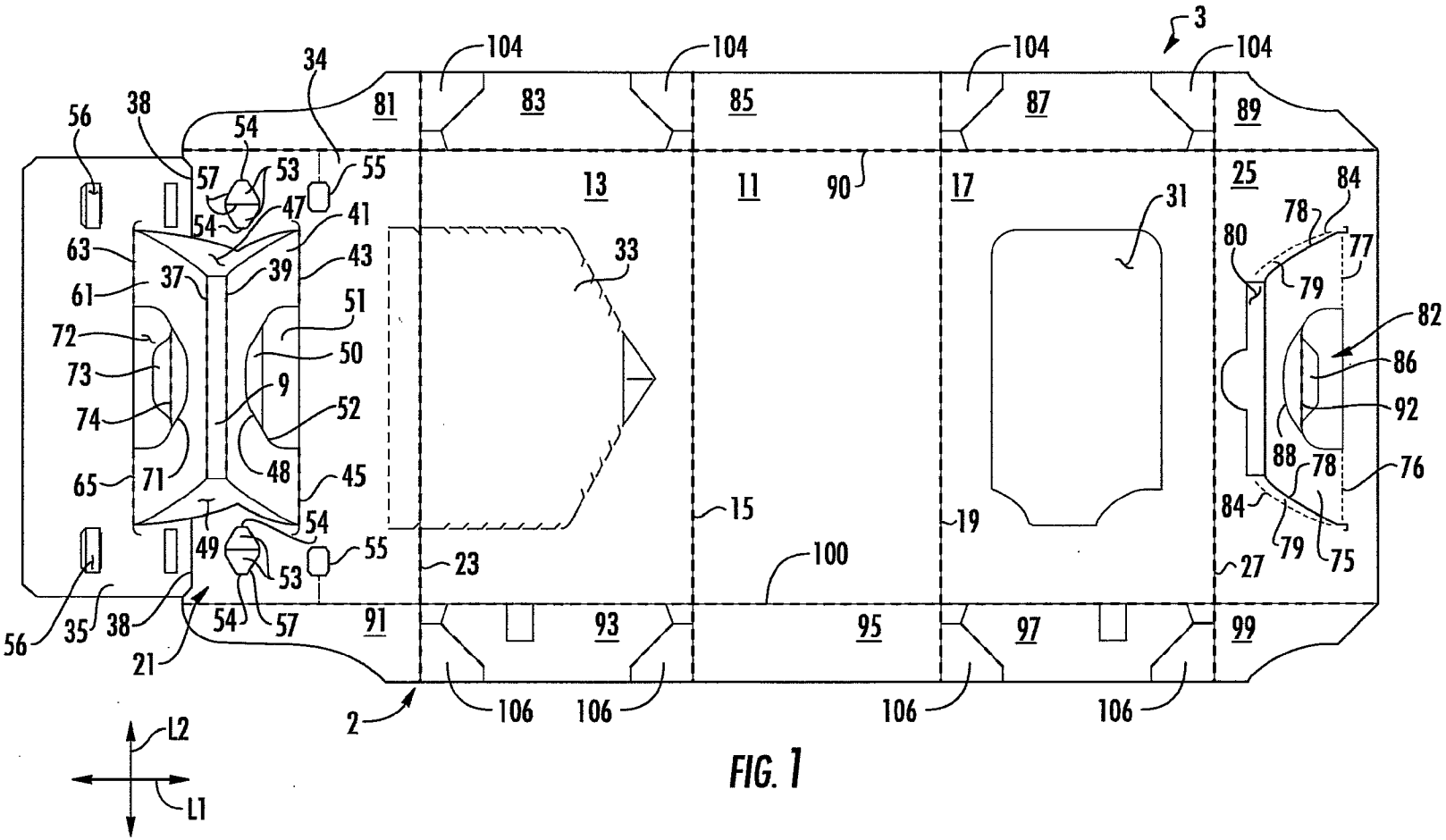
FIG. 1 is a plan view of a blank used to form a carton according to a first exemplary embodiment of the disclosure.
Figure 3:
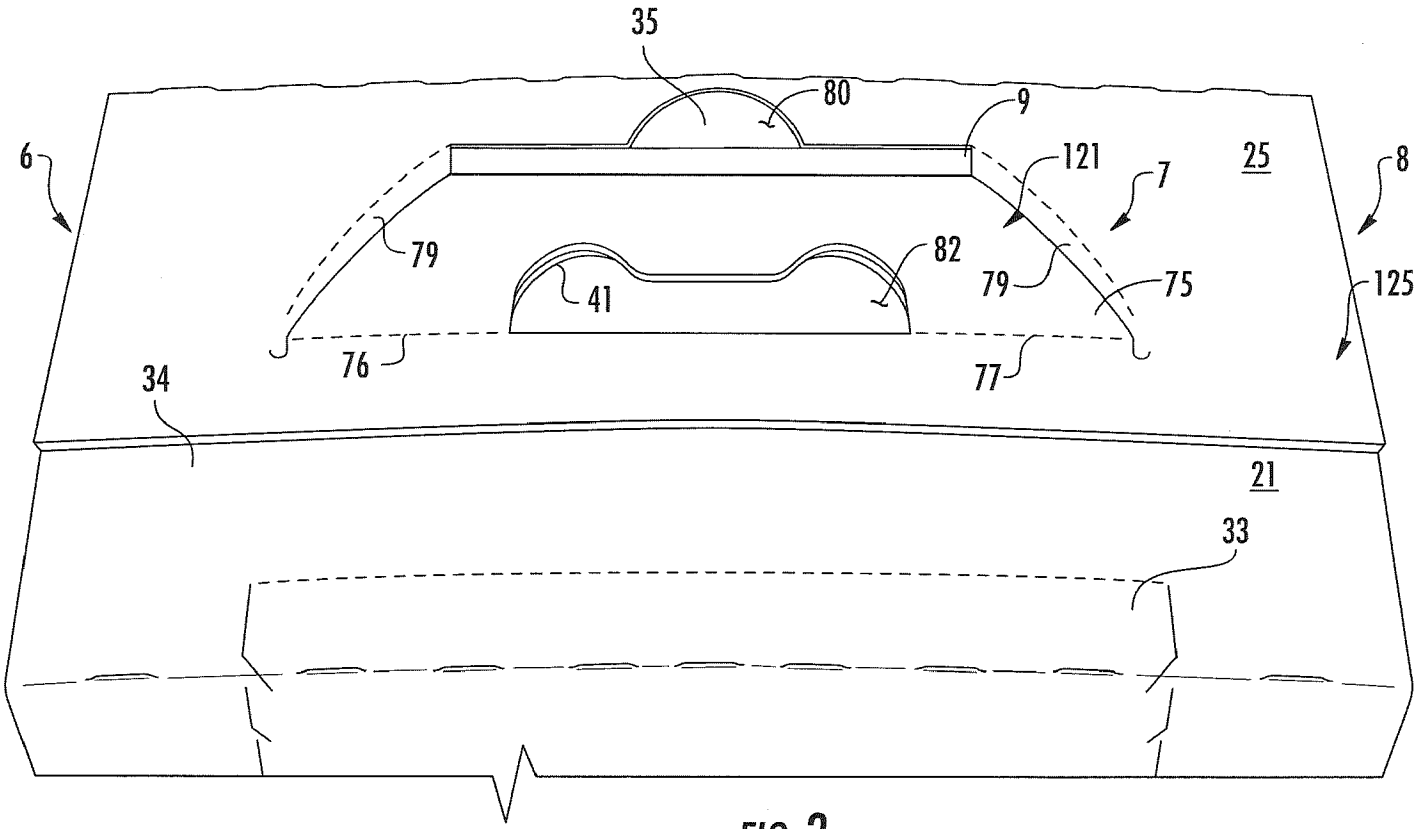
FIG. 3 is a perspective view of the erected carton according to the first exemplary embodiment of the disclosure.
Figure 4:
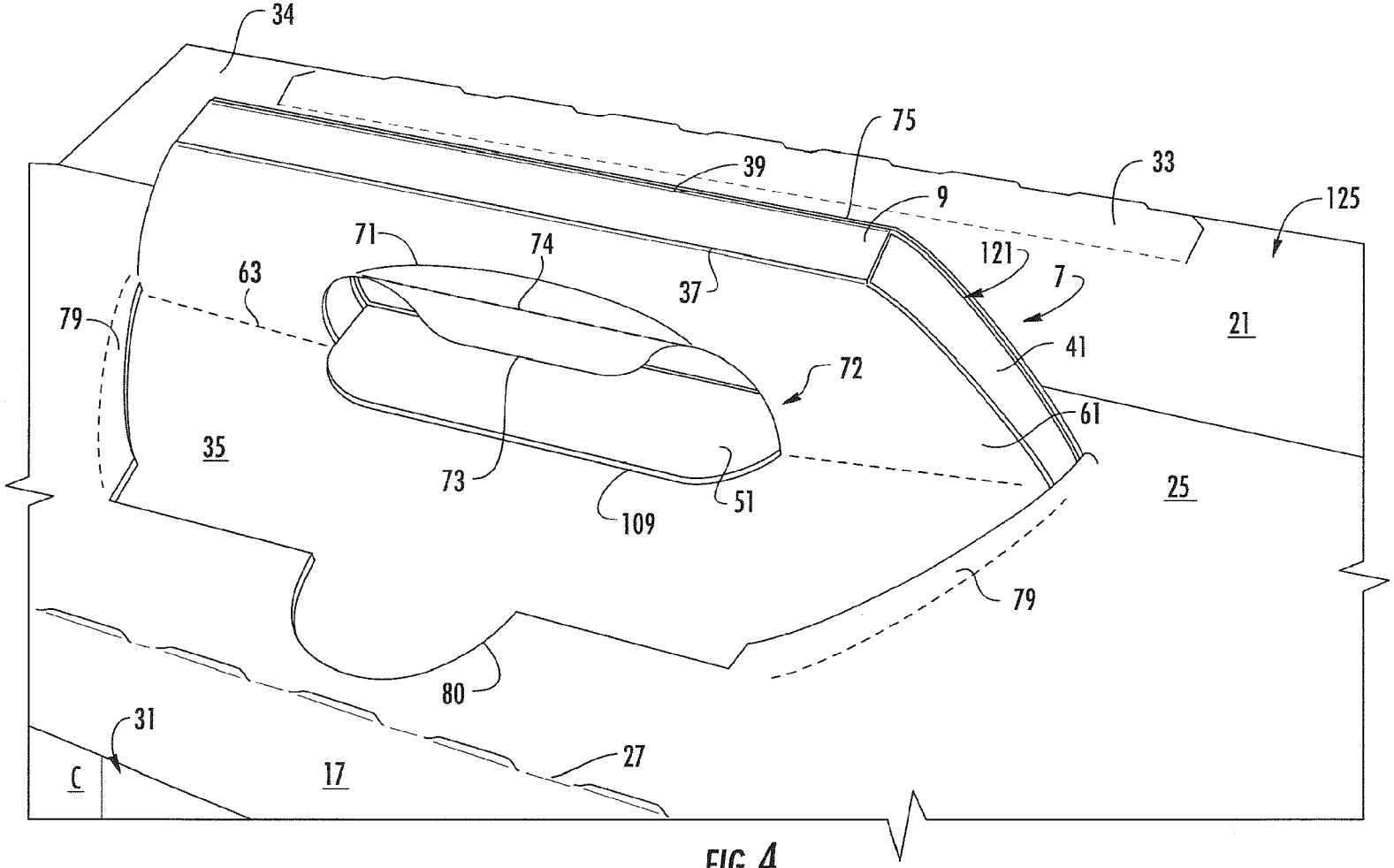
FIGS. 4 and 5 are perspective views showing the actuation of a handle of the carton of FIG. 3.
Figure 5:
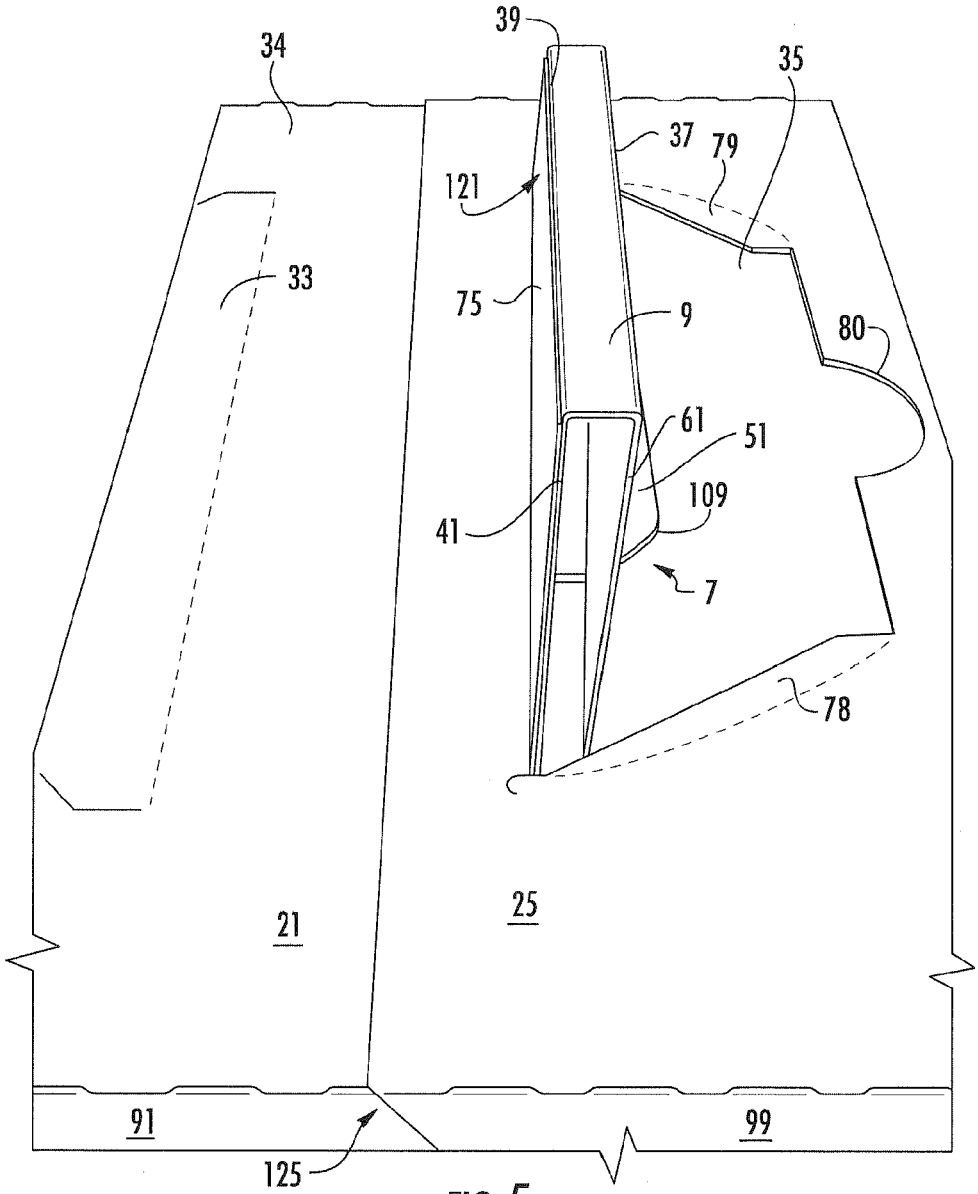

FIG. 1 is a plan view of an exterior surface 2 of a blank 3, used to form a carton 5, shown in FIGS. 3-5, according to one embodiment of the disclosure. The carton 5 can be used to house a plurality of articles such as containers C (e.g., see exemplary containers C shown in FIGS. 8 and 9 of the second embodiment). In one embodiment, the containers C can be brick-shaped containers commonly referred to as TETRA PAK© containers that contain a liquid beverage or other food or beverage product. The containers C can be any suitable container such as any shape, size, and type of container that is commercially available from Tetra Pak International SA, Lausanne, Switzerland, such as TETRA BRIK packages, TETRA BRIK ASEPTIC packages, TETRA PRISM ASEPTIC packages, or any other suitable package or container (see www.tetrapak.com for more information). The containers C could be other suitable containers made from other materials by other manufactures (e.g., PET bottles, yogurt containers, juice-boxes, beverage cans, etc.) without departing from the disclosure.

In one embodiment, the blank 3 is sized to form a carton 5 that contains twelve containers C or packages in a single layer in a 3×4 arrangement. But, it is understood that the blank 3 and/or carton 5 may be sized and shaped to hold containers C of a different or same quantity in more than one layer and/or in different row/column arrangements (e.g., 1×6, 2×3, 2×6, 2×4, 2×2, 2×6×2, 2×4×2, 2×9, etc.). In the illustrated embodiment, the carton 5 has at least partially open ends 6, 8 and generally wraps around the containers C contacting the top and bottom of the group of containers. In one embodiment, the carton 5 may be referred to as a "wrap-around carton or carrier." Alternatively, the carton 5 could be a carton with ends that are at least partially closed by one or more end flaps with the containers being loaded into the partially formed carton prior to closing one or more ends of the carton without departing from the disclosure.

The carton 5 has a reinforced handle 7 (FIGS. 3-5) that is used for grasping and carrying the carton. The handle 7 is formed by multiple layers of material of the blank 3 so that the handle is strengthened to reduce handle failure and has a thickness to enhance comfort in carrying the carton. According to one embodiment of the invention, the handle 7 is formed of at least three layers of material, with one portion of the handle comprising a dual-layer (e.g., formed from a first handle panel 41 and a third handle panel 75) and another portion of the handle comprising a single layer (e.g., formed from a second handle panel 61). According to another embodiment of the invention, the handle 7 is formed of at least two layers of material, with one portion of the handle comprising a single layer and another portion of the handle comprising a single layer. The thickness of the handle 7 is produced by an intermediate handle panel 9 and an associated spacing between the handle portions noted above. The intermediate handle panel 9 may have any desired width. According to at least one embodiment of the invention, the handle panel 9 comprises a width comparable to about two layers of corrugated cardboard stock. In this manner, the handle 7 may produce a unique and sturdy "feel" that is comparable to a corrugated cardboard handle while actually being formed of relatively thinner paperboard material. The handle 7 could be otherwise shaped, arranged, and/or configured or could be omitted without departing from the disclosure.

As shown in FIG. 1, the blank 3 has a longitudinal axis L1 and a lateral axis L2. In the illustrated embodiment, the blank 3 comprises a bottom panel 11 foldably connected to a first side panel 13 at a lateral fold line 15, a second side panel 17 foldably connected to the bottom panel at a lateral fold line 19, a first top panel 21 foldably connected to the first side panel 13 at a lateral fold line 23, and a second top panel 25 foldably connected to the second side panel 17 at a lateral fold line 27. In one embodiment, the second side panel 17 includes an opening or window 31. In one embodiment, the first top panel 21 and the first side panel 13 include a dispenser 33.

In the illustrated embodiment, the first top panel 21 includes a main portion 34 foldably connected to the first side panel 13 at the fold line 23 and a distal portion 35 foldably connected to the main portion 34 by the first and second handle panels 41, 61 and the intermediate panel 9. The distal portion 35 is also partially separated from the main portion 34 through lateral cuts 38. The first handle panel 41 is foldably connected to the main portion 34 at lateral fold lines 43, 45 and is at least partially defined by cut outs 47, 49 in the top panel 21. As shown in FIG. 1, the first handle panel 41 can include a handle flap 50 that is foldably connected to the first handle panel along a curved fold line 48. An elongate projection 51 is adjacent the first handle panel 41 in the main portion 34 of the first top panel 21 and is at least partially defined by arcuate cut 52. The main portion 34 of the first top panel 21 includes two pairs of locking tabs 53 that are generally aligned in the longitudinal direction L1 and are spaced apart in the longitudinal direction L1, and a plurality of glue openings 55 that are generally aligned in the longitudinal direction L1 and are spaced apart in the longitudinal direction L1. As shown in FIG. 1, the locking tabs 53 are foldably connected to the main portion 34 along respective longitudinal fold lines 54 and are separable from the main portion 34 along cuts 57 formed therein. The distal portion 35 of the first top panel 21 has a plurality of locking openings 56 that are generally aligned in the longitudinal direction L1 and are spaced apart in the longitudinal direction L1. As will be discussed later below, the locking tabs 53, the locking openings 55, and the glue openings 56 can cooperate to help secure the main portion 34 of the first top panel 21 to the distal portion 35 of the top panel.

In the first embodiment, the second handle panel 61 foldably connected to the distal portion 35 of the top panel 21 along lateral fold lines 63, 65 and to the intermediate handle panel 9 at fold line 37. The intermediate handle panel 9 is foldably connected to the first handle panel 41 at fold line 39. In the illustrated embodiment, the second handle panel 61 is at least partially defined by the cutouts 47, 49. Also, a comfort flap 73 is foldably connected to the second handle panel 61 along a curved fold line 71 and includes a lateral fold line 74. The second handle panel 61 and the comfort flap 73 can be at least partially defined by an opening 72 in the distal portion 35.

As shown in FIG. 1, the third handle panel 75 is foldably connected to the second top panel 25 at two lateral fold lines 76, 77. The third handle panel 75 is at least partially defined by cuts 78 and an opening 80. The cuts 78 and the opening 80 can at least partially form respective flaps 79 in the second top panel 25. The flaps 79 can be further defined by arcuate fold lines 84 and can help retain the handle 7 in the closed position (FIG. 3) by at least partially overlapping at least the second handle panel 61 when the handle is in the flattened position. When the handle 7 is actuated, the second handle panel 61 can push the flaps 79 upwardly out of the way as the second handle panel is folded upwardly. As shown in FIG. 1, a handle flap 86 can be foldably connected to the third handle panel 75 along a curved fold line 88 and can include a lateral fold line 74. The third handle panel 75 and the handle flap 86 can be at least partially defined by an opening 82 in the second top panel 25. The first handle panel 41, the second handle panel 61, the third handle panel 75, and the intermediate handle panel 9 combine to form the handle 7 in a manner that will be described in further detail below. One or more of the handle panels 9, 41, 61, 75 could be otherwise shaped, arranged, configured, and/or omitted without departing from the disclosure.

In one embodiment, the panels 11, 13, 17, 21, 25 have respective first end flaps 81, 83, 85, 87, 89 at a first marginal portion of the blank 3 such that the first end flaps are foldably connected to respective panels by a longitudinal fold line 90. The panels 11, 13, 17, 21, 25 have respective second end flaps 91, 93, 95, 97, 99 at a second marginal portion of the blank 3 such that the second end flaps are foldably connected to respective panels by a longitudinal fold line 100. The first end flaps 81, 83, 85, 87, 89 are for at least partially closing the first end 6 of the carton 5 and the second end flaps 91, 93, 95, 97, 99 are for at least partially closing the second end 8 of the carton. One or more of the first end flaps 81, 83, 85, 87, 89 and second end flaps 91, 93, 95, 97, 99 can be foldably connected to each other at respective fold lines, or one or more of the end flaps can have respective gussets or webs foldably connecting adjacent first or second end flaps or one or more of the end flaps can be tuck-in panels or flaps without departing from the disclosure. In the illustrated embodiments, the end flaps 83, 93, 87, 97 are tuck-in flaps that are folded into face-to-face contact with the respected side panels 13, 17 and are disposed between a container C adjacent the respective side panel 13, 17 and the respective side panel. The tuck-in flaps 83, 87 are connected to the bottom end flap 85 and to the respective top end flaps 81, 89 by respective gussets 104 so that the end flaps 81, 89 can extend over the partially closed end 6 when the tuck-in flaps 83, 87 are in face-to-face contact with the side panels 13, 17. Similarly, the tuck-in flaps 93, 97 are connected to the bottom end flap 95 and to the respective top end flaps 91, 99 by respective gussets 106 so that the end flaps 91, 99 can extend over the partially closed end 8 when the tuck-in flaps 93, 97 are in face-to-face contact with the side panels 13, 17. The end flaps could be otherwise shaped, arranged, configured, and/or omitted without departing from the disclosure.

Figure 2:
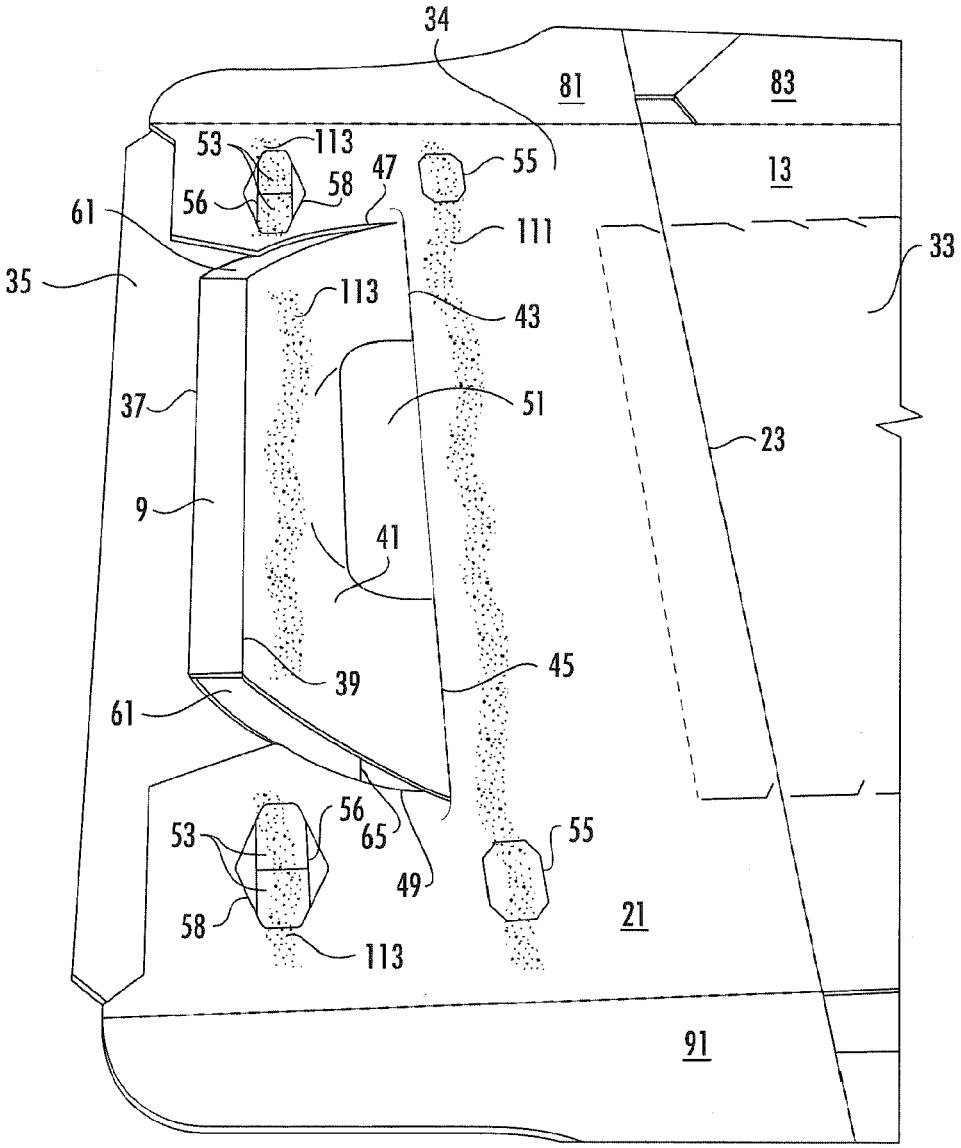
FIG. 2 is a perspective view of a partially-erected carton according to the first exemplary embodiment of the disclosure.

FIGS. 2 and 3 show one exemplary method of forming the blank 3 into the carton 5. In one embodiment, the blank is first placed with an interior surface facing up and containers C are placed on the bottom panel 11. Prior to or after placing the containers C on the bottom panel 11, the distal portion 35 of the first top panel 21 can be positioned relative to the main portion 34 as shown in FIG. 2 to begin forming the thickened handle 7. The distal portion 35 is positioned such that the second handle panel 61 is folded generally underneath the first handle panel 41 and the intermediate portion 9 about the fold line 37 with the interior surface of the second handle panel 61 being at least partially in face-to-face registration with the interior portion of the first handle panel 41 and the intermediate handle panel 9 (FIG. 2). The distal portion 35 is folded with respect to the second handle panel 61 along the fold lines 63, 65 so that the exterior surface of the distal portion 35 is at least partially in face-to-face contact with the exterior surface of the second handle panel 61 and an interior surface of the main portion 34 of the first top panel 21. The locking tabs 53 in the main portion 34 can be folded downwardly along fold lines 57 through the respective locking openings 56 so that the wider portions of the locking tabs 53 engage underneath the distal portion 35. The locking tabs 53 can form respective openings 58 in the main portion 34 when folded down along fold lines 57. When the main portion 34 and distal portion 35 of the first top panel 21 are positioned as shown in FIG. 2, glue 111, 113 (e.g., glue strips) or other adhesive can be applied as indicated. The glue 111 can be applied in a laterally extending line across openings 55. The glue 113 can be applied in a laterally extending line across openings 58, the first handle panel 41 and the exterior surface of the main portion 34. The glue 111, 113 applied across the openings 58, 55 can also be applied to the portions of the locking tabs 53 and the distal portion 35 that are located below the openings 58, 55. The locking features and/or the glue 111, 113 could be otherwise shaped, arranged, configured, and/or omitted without departing from the disclosure.

In one embodiment, a leading edge portion 109 of the main portion 34, or other features of the handle 7, can have engaging or locking features that engage one or more features or portions of the distal portion 35 or other feature to allow the handle 7 to be formed without the need for glue or tape. In one embodiment, the folding of the distal portion 35 relative to the main portion 33 of the first top panel 21 from the position of FIG. 1 to the position of FIG. 2 can be a "Z-fold" with the handle panel 61 being folded relative to the handle panel 41 at fold line 37 and the distal portion 35 being moved or slid in the longitudinal direction L1 so that the exterior surface of the distal portion generally fits below the interior surface of the main portion as the handle panel 61 folds under the handle panel 41. Further, the handle 7 could be formed by other features or the features shown and described herein could be otherwise shaped, arranged, configured, and/or omitted without departing from the disclosure.

Turning back to FIG. 1, the blank 3 may be formed around a container or containers such that the first top panel 21, with the main portion 34 and the distal portion 35, positioned as described above, contacts the tops of the containers. The second side panel 17 can be folded up against the containers and the second top panel 25 positioned to overlap the first top panel 21. The third handle panel 75 overlaps the first handle panel 41 and is adhered to the first handle panel by the glue 113 applied to the first handle panel 41 (FIG. 3). The second top panel 25 is secured to the main portion 34 of the top panel 21 and to the folded under distal portion 35 of the top panel 21 through the openings 58, 55 in the main portion 34 by the glue 111, 113.

The handle 7 of the carton 5 includes a reinforced handle portion 121 that is formed by the two handle panels 41, 75 that are overlapped and adhered in the manner described above or an alternative method of forming. The handle 7 is shown in a first position in FIG. 3 and can be actuated to a second position shown in FIGS. 4 and 5. For example, the handle 7 can be grasped at the opening 80 (e.g., grasping the second handle panel 61) and lifted, folding the second handle panel 61, the intermediate handle panel 9, and the handle portion 121 along fold lines 37, 39, 41, 45, 63, 65, 76, 77. As the handle 7 is folded upwardly (FIGS. 4 and 5), the first handle panel 41 can separate from the projection 51 along the cut line 52, forming the leading edge 109, the intermediate portion 9 can pass through the opening 80 in the second top panel 25, and the handle panel 61 and the handle portion 121 can push past the flaps 79 in the second top panel 25. Accordingly, the handle 7 pushes the flaps 79 upwardly along the curved fold lines 84 as the handle panel 61 and the handle portion 121 are pivoted upwardly. As shown in FIG. 3, the carton 5 includes a reinforced top wall 125 that is formed by the overlapping and adhering of the three layers of material (e.g., the second top panel 25 and the distal portion 35 and the main portion 34 of the first top panel 21).

In one embodiment, the handle 7 includes the reinforced handle portion 121 and the second handle panel 61 that can extend upwards from the top wall 125 when the handle is activated in the second position (FIGS. 4 and 5). Further, the handle 7 includes the intermediate handle panel 9 that is foldably connected to the reinforced handle portion 121 and the second handle panel 61. In one embodiment, the intermediate handle panel 9 maintains the spaced-apart distance between the reinforced handle portion 121 and the second handle panel 61 so the handle 7 has a thickness when grasped by the user. The intermediate handle panel 9 can be generally orthogonal relative to the reinforced handle portion 121 and the second handle panel 61, or the intermediate handle panel 9 could be otherwise shaped, arranged, and/or positioned (e.g., angled) without departing from the scope of the disclosure.

Figure 6:
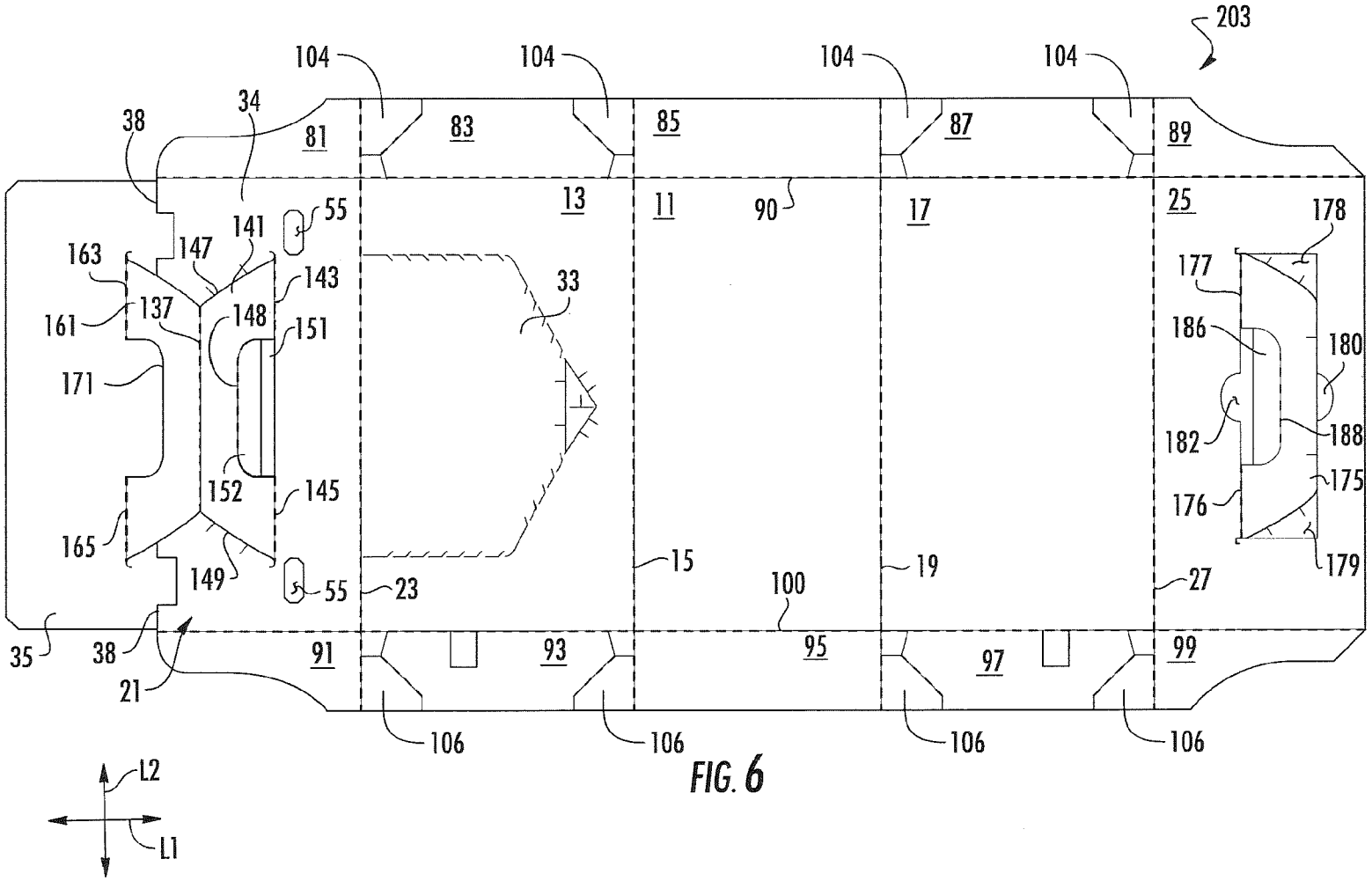
FIG. 6 is a plan view of a blank used to form a carton according to a second exemplary embodiment of the disclosure.

FIG. 6 shows a blank 203 of a second embodiment of the disclosure having similar features as the first embodiment. Accordingly, similar or identical features of the embodiments are provided with identical or similar reference numbers.

Figure 8:
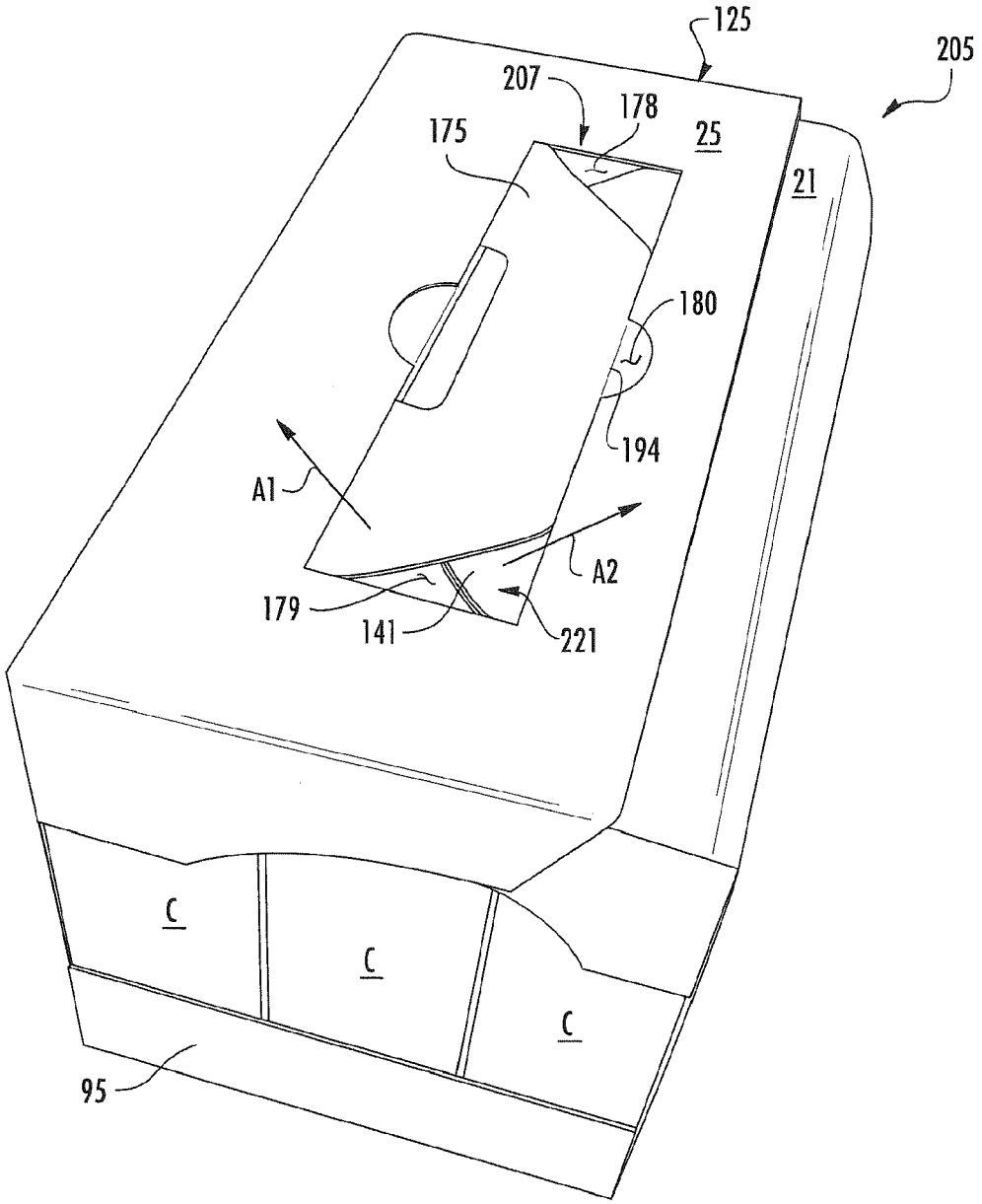
FIG. 8 is a perspective view of the erected carton according to the second exemplary embodiment of the disclosure.
Figure 9:
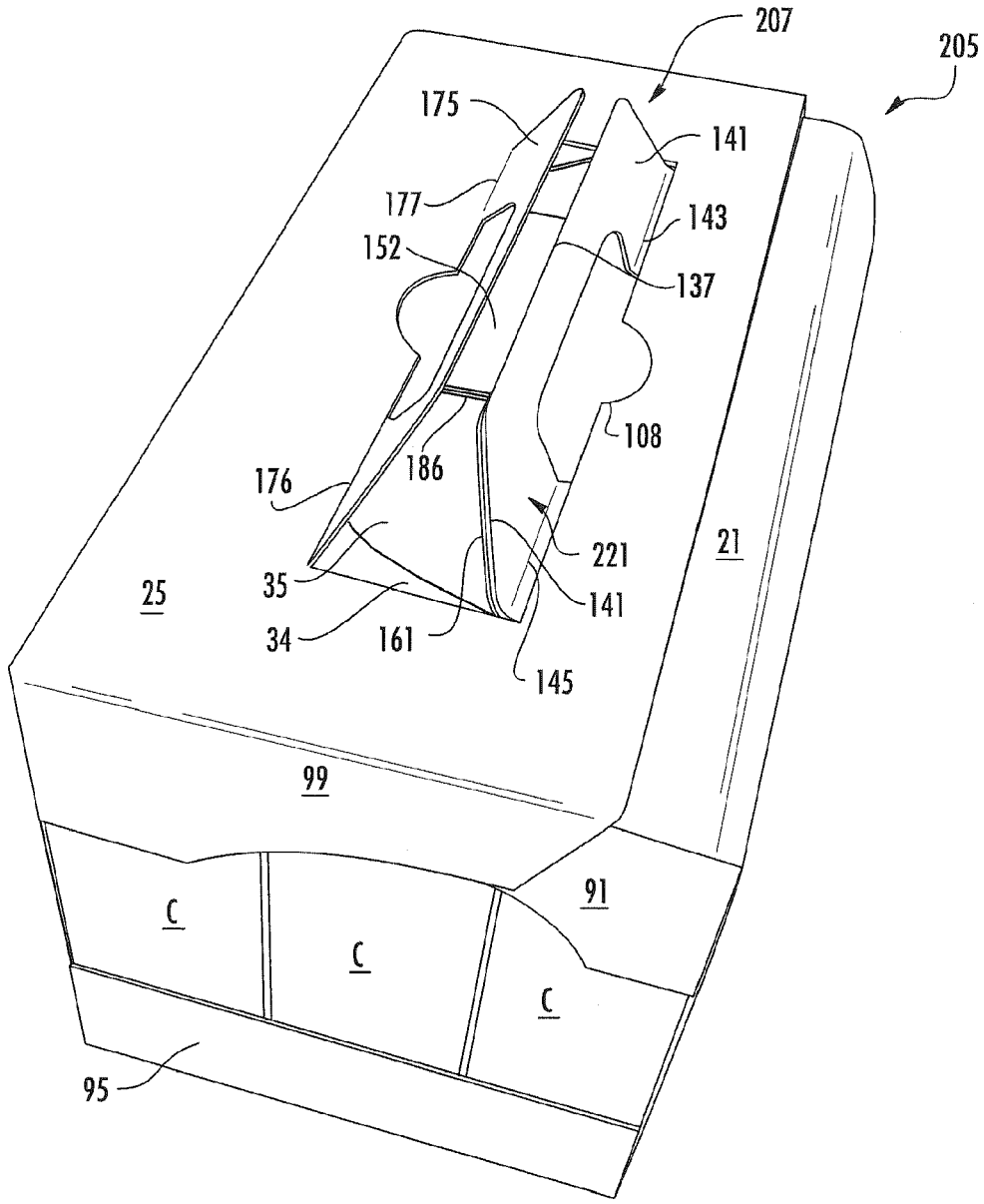
FIG. 9 is a perspective view of the carton of FIG. 3 showing the actuation of a handle.

The blank 203 may be used to form a carton 205 (FIGS. 8 and 9). The carton 205 has a reinforced handle 207 that is used for grasping and carrying the carton. The handle 207 is formed by multiple layers of material of the blank 203 so that the handle is strengthened to reduce handle failure, and thickened in a triangular formation to enhance comfort in carrying the carton. According to one embodiment of the invention, the handle 207 is formed of at least three layers of material, with one portion of the handle comprising a dual-layer (e.g., a first handle panel 141 and a second handle panel 161) and another portion of the handle comprising a single layer (e.g., a third handle panel 175). According to another embodiment of the invention, the handle 207 is formed of at least two layers of material, with one portion of the handle comprising a single layer and another portion of the handle comprising a single layer. The thickness of the handle 207 is produced by a triangular arrangement facilitated by an associated spacing between the handle portions. In this manner, the handle 207 may produce a unique and sturdy "feel" which is comparable to a corrugated cardboard handle while actually being formed of relatively thinner paperboard material.

As shown in FIG. 6, the blank 203 has a longitudinal axis L1 and a lateral axis L2. In the illustrated embodiment, the first top panel 21 includes a main portion 34 foldably connected to the first side panel 13 at the fold line 23 and a distal portion 35 foldably connected to the main portion 34 by at least the first handle panel 141 and the second handle panel 161. The first handle panel 141 is foldably connected to the main portion 34 at lateral fold lines 143, 145 and at least partially defined by tear or cut lines 147, 149 in the top panel 21. An elongate handle flap 152 is foldably connected to the first handle panel 141 along a lateral fold line 148 adjacent an opening in the main portion 34 of the first top panel 21.

In the illustrated embodiment, the second handle panel 161 is foldably connected to the first handle panel 141, through the fold line 137. The second handle panel 161 is foldably connected to the distal portion 35 at lateral fold lines 163, 165 and is at least partially defined by the cut lines 147, 149. Also, the second handle panel 161 is defined by a curved cut 171.

As also shown in FIG. 6, the third handle panel 175 is foldably connected to the second top panel 25 at two lateral fold lines 176, 177. The third handle panel 175 is at least partially defined by cutouts 178, 179 and an opening 180 adjacent to the third handle panel 175. In the illustrated embodiment, the third handle panel 175 can include an elongate handle flap foldably connected to the third handle panel along lateral fold line 188 adjacent an opening 182 in the second top panel 25. The first handle panel 141, the second handle panel 161, and the third handle panel 175 combine to form the handle 207 in a manner that will be described in further detail below. One or more of the handle panels 141, 161, 175 could be otherwise shaped, arranged, and/or omitted without departing form the disclosure.

Figure 7:
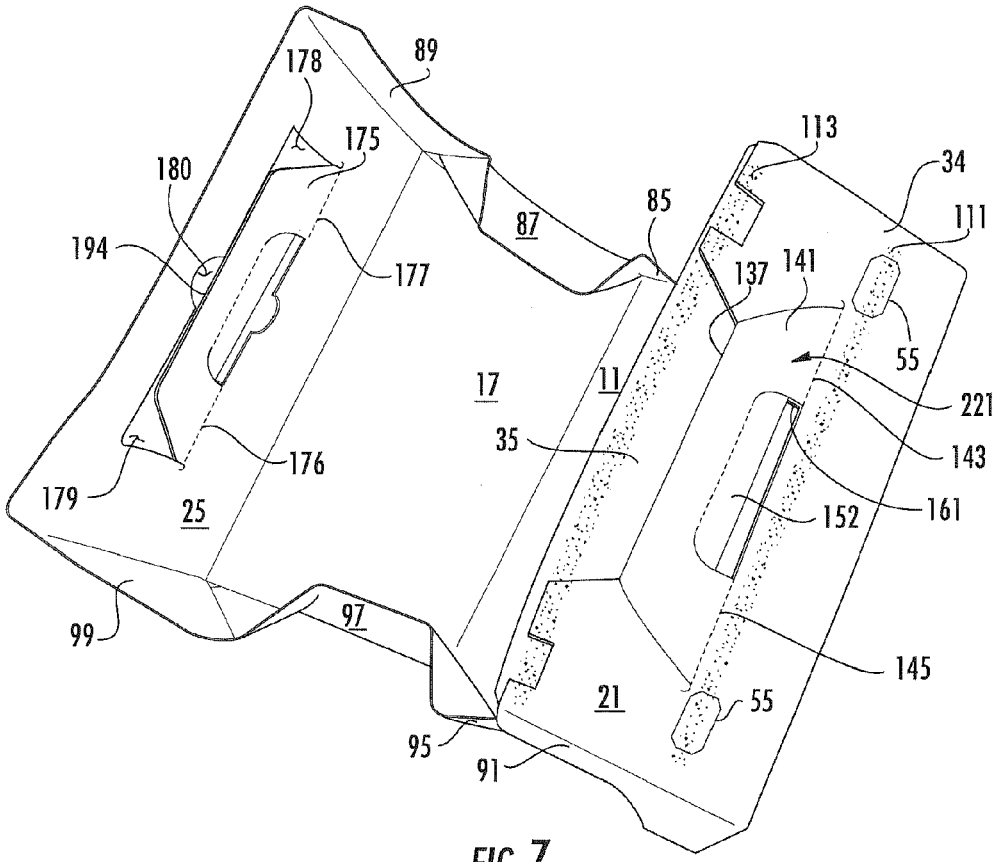
FIG. 7 is a perspective view of a partially-erected carton according to the second exemplary embodiment of the disclosure.

In the illustrated embodiment, the carton 205 can be erected from the blank 203 (FIGS. 7 and 8) in a similar manner as the carton 5 is erected in the first embodiment. However, the distal portion 35 of the first top panel 21 and the second handle panel 161 are "Z-folded" under the main portion 34 of the first top panel 21 by folding the second handle panel 161 along the lateral fold line 137 so that the interior surface of the second handle panel 161 is at least partially in face-to-face contact with the interior surface of the first handle panel 141 to form the reinforced handle portion 221. In one embodiment, the first and second handle panels 141, 161 are generally the same size and the first handle panel overlaps substantially all of the second handle panel when the handle 207 is formed. Additionally, the first handle panel 141 and the second handle panel 161 can be glued together to form the handle portion 221 in one embodiment. Alternatively, the handle panels could be differently shaped and/or otherwise configured. The distal portion 34 is folded relative to the second handle panel 161 along the lateral fold lines 163, 165 so that the exterior surface of the distal portion 35 is at least partially in face-to-face contact with the exterior surface of the second handle panel 161 and the interior surface of the main portion 34.

The containers C can be placed on the bottom panel 11, and the side panels 13, 17 can be folded upwardly while folding the tuck-in flaps 83, 93, 87, 97 against the respective side panels 13, 17. The side panels 13, 17 and the tuck-in flaps 83, 93, 87, 97 can be folded against the containers C, and the top and bottom end flaps 81, 85, 89, 91, 95, 99 can be folded downwardly over the ends 6, 8 of the carton 205. The first top panel 21 can be folded over the tops of the containers C, and the second top panel 25 can overlap the first top panel 21. In one embodiment, the second top panel 25 is glued to the main portion 34 and the distal portion 35 of the first top panel 21 by glue strips 111, 113. The third handle panel 175 can at least partially overlap the first handle panel 141 as shown in FIG. 8. In one embodiment, an upper edge 194 of the third handle panel 175 can overlap or be generally aligned with at least a portion of the lateral fold lines 143, 145 and/or 163, 165, and the fold line 137 can overlap or be generally aligned with at least a portion of the lateral fold lines 177, 176 when the handle 207 is in the closed or flat position of FIG. 8. The carton 205 could be otherwise erected without departing from the disclosure.

FIGS. 8 and 9 show the carton 205 formed of the blank 203. As illustrated, the carton 205 is substantially similar in form and function to the carton 5 described in detail above. The handle 207 is arranged on an upper or top portion of the carton 205, and may be actuated from a first position (FIG. 8) to a second position (FIG. 9) by first separating the third handle panel 175 and rotating it in a direction A1 (FIG. 8) and subsequently separating the first and second handle panels (i.e., reinforced portion 221) and rotating in a direction A2 (FIG. 8) to erect the handle 207 as illustrated in FIG. 9.

In one embodiment, the handle 207 includes the reinforced handle portion 221 and the third handle panel 75 that can be folded in the opposite directions illustrated by arrows A1 and A2 (FIG. 8) to extend upwards from the carton 205 when the handle is activated. In one embodiment, the reinforced handle portion may be erected to be orthogonal or angled relative to the carton 205, and the third handle panel 175 may be erected to be orthogonal or angled relative to the carton 205. As shown in FIG. 9, the handle flaps 152, 186 can be folded relative to the first handle panel 141 and the third handle panel 175 to at least partially overlap and to extend at least partially between the handle portion 221 and the third handle flap 175. The reinforced handle portion 221 and the third handle panel 175 could be otherwise shaped, arranged, and/or positioned (e.g., angled) without departing from the scope of the disclosure.

In general, the blanks described herein may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles, the carton comprising:

a plurality of panels that extends at least partially around an interior of the carton, the plurality of panels comprising at least a top panel, wherein the top panel comprises a main portion and a distal portion; and a handle being positionable between a first position and a second position, the handle comprising a first handle panel foldably connected to the main panel and a second handle panel foldably connected to the distal portion and the first handle panel, the top panel has an interior surface on a first side of the top panel and an exterior surface on a second side of the top panel, the top panel comprises a Z-fold between the distal portion, the second handle panel, the first handle panel, and the main portion, the Z-fold comprises the exterior surface of the second handle panel at least partially in face-to-face contact with the exterior surface of the distal portion, the interior surface of the second handle panel at least partially in face-to-face contact with the interior surface of the first handle panel, and the interior surface of the main portion at least partially in face-to-face contact with the exterior surface of the distal portion.

2. The carton of claim 1, wherein the handle further comprises a third handle panel in face-to-face contact with the first handle panel for reinforcing the handle, the first handle panel is foldably connected to the main portion of the top panel along a first fold line, and the second handle panel is foldably connected to the distal portion of the top panel along a second fold line.

3. The carton of claim 2, wherein the top panel is a first top panel, the plurality of panels further comprises a second top panel at least partially overlapping the first top panel, and the third handle panel is foldably connected to the second top panel along a third fold line.

4. The carton of claim 1, wherein the handle comprises an intermediate panel that is foldably connected to the first handle panel and the second handle panel.

5. The carton of claim 4, wherein the intermediate panel is foldably connected to the first handle panel along a third transverse fold line, and the intermediate panel is foldably connected to the second handle panel along a fourth transverse fold line.

6. The carton of claim 3, wherein the second top panel is at least partially adhered to the main portion and the distal portion of the first top panel.

7. The carton of claim 1, wherein the top panel comprises at least one locking tab foldably connected to the main portion, and the at least one locking tab is folded downwardly at least partially through a locking opening in the distal portion to engage the interior surface of the distal portion.

8. The carton of claim 1, wherein the top panel is a first top panel, the plurality of panels further comprises a second top panel at least partially overlapping the first top panel, the main portion comprises at least one glue opening, and the distal portion is at least partially adhered to the second top panel through the at least one glue opening.

9. The carton of claim 1, wherein the first handle panel is generally coplanar with at least a portion of the top panel in the first position of the handle, and each of the first handle panel and the second handle panel extends upwardly relative to the top panel in the second position of the handle.

10. A blank for forming a carton, the blank comprising:

a plurality of panels comprising at least a top panel, the top panel comprising a main portion and a distal portion; and handle features for forming a handle that is positionable between a first position and a second position in the carton formed from the blank, the handle features comprising a first handle panel foldably connected to the main panel and a second handle panel foldably connected to the distal portion and the first handle panel, the top panel has an interior surface on a first side of the blank and an exterior surface on a second side of the blank, the top panel comprises a Z-fold between the distal portion, the second handle panel, the first handle panel, and the main portion, the Z-fold comprises the exterior surface of the second handle panel at least partially in face-to-face contact with the exterior surface of the distal portion, the interior surface of the second handle panel at least partially in face-to-face contact with the interior surface of the first handle panel, and the interior surface of the main portion at least partially in face-to-face contact with the exterior surface of the distal portion.

11. The blank of claim 10, wherein the handle features further comprise a third handle panel for being disposed in face-to-face contact with the first handle panel when the carton is formed from the blank, the first handle panel is foldably connected to the main portion of the top panel along a first fold line, and the second handle panel is foldably connected to the distal portion of the top panel along a second fold line.

12. The blank of claim 11, wherein the top panel is a first top panel, the plurality of panels further comprises a second top panel for being positioned to at least partially overlap the first top panel when the carton is formed from the blank, and the third handle panel is foldably connected to the second top panel along a third fold line.

13. The blank of claim 10, wherein the handle features comprise an intermediate panel that is foldably connected to the first handle panel and the second handle panel.

14. The blank of claim 13, wherein the intermediate panel is foldably connected to the first handle panel along a third transverse fold line, and the intermediate panel is foldably connected to the second handle panel along a fourth transverse fold line.

15. The blank of claim 10, wherein the top panel comprises at least one locking tab foldably connected to the main portion, and the at least one locking tab is folded downwardly at least partially through a locking opening in the distal portion to engage the interior surface of the distal portion.

16. The blank of claim 10, wherein the top panel is a first top panel, the plurality of panels further comprises a second top panel for at least partially overlapping the first top panel when the carton is formed from the blank, the main portion comprises at least one glue opening, and the distal portion is at least partially adhered to the second top panel through the at least one glue opening.

17. The blank of claim 10, wherein the distal portion of the top panel is separable from the main portion of the top panel along a cut line.

18. A method of forming a carton comprising:

obtaining a blank comprising a plurality of panels comprising at least a top panel comprising a main portion and a distal portion, and handle features comprising at least a first handle panel foldably connected to the main panel and a second handle panel foldably connected to the distal portion and the first handle panel, the top panel has an interior surface on a first side of the blank and an exterior surface on a second side of the blank;

forming an interior of the carton at least partially defined by the plurality of panels;

forming a handle from the handle features by forming a Z-fold in the top panel between the distal portion, the second handle panel, the first handle panel, and the main portion, the forming the Z-fold comprises positioning the exterior surface of the second handle panel at least partially in face-to-face contact with the exterior surface of the distal portion, positioning the interior surface of the second handle panel at least partially in face-to-face contact with the interior surface of the first handle panel, and positioning the interior surface of the main portion at least partially in face-to-face contact with the exterior surface of the distal portion.

19. The method of claim 18, wherein the handle features further comprise a third handle panel, the first handle panel is foldably connected to the main portion of the top panel along a first fold line, the second handle panel is foldably connected to the distal portion of the top panel along a second fold line, and the forming the handle comprises positioning the third handle panel in face-to-face contact with the first handle panel to reinforce the handle.

20. The method of claim 19, wherein the top panel is a first top panel, the plurality of panels further comprises a second top panel, the third handle panel is foldably connected to the second top panel along a third fold line, and the forming the interior of the carton further comprises positioning the second top panel to at least partially overlap the first top panel.

21. The method of claim 18, wherein the handle features further comprise an intermediate panel that is foldably connected to the first handle panel and the second handle panel.

22. The method of claim 18, wherein the main portion comprises at least one locking tab foldably connected to the main portion, the forming the Z-fold comprises downwardly folding the at least one locking tab at least partially through a locking opening in the distal portion to engage the interior surface of the distal portion.

23. The method of claim 18, wherein the main portion comprises at least one glue opening and the forming the Z-fold comprises adhering the distal portion to the second top panel at least through the at least one glue opening.

24. The method of claim 18, wherein the distal portion of the top panel is separable from the main portion of the top panel along a cut line and the forming the Z-fold comprises sliding an edge of the distal portion formed at the cut line under the main portion.

* * * * *